US007066711B2

(12) United States Patent
Jäger et al.

(10) Patent No.: US 7,066,711 B2
(45) Date of Patent: Jun. 27, 2006

(54) DELIVERY PUMP

(75) Inventors: Bernd Jäger, Fritzlar (DE); Peter Marx, Wasbüttel (DE); Hans-Peter Osburg, Bargteheide (DE)

(73) Assignee: Siemens Aktiengesellschaft, Munich (DE)

( * ) Notice: Subject to any disclaimer, the term of this patent is extended or adjusted under 35 U.S.C. 154(b) by 114 days.

(21) Appl. No.: 10/478,033

(22) PCT Filed: May 17, 2002

(86) PCT No.: PCT/DE02/01831

§ 371 (c)(1),
(2), (4) Date: Apr. 27, 2004

(87) PCT Pub. No.: WO02/095236

PCT Pub. Date: Nov. 28, 2002

(65) Prior Publication Data

US 2004/0170493 A1 Sep. 2, 2004

(30) Foreign Application Priority Data

May 22, 2001 (DE) ..... 101 25 142

(51) Int. Cl.
*F04D 29/40* (2006.01)

(52) U.S. Cl. ..... 415/55.1

(58) Field of Classification Search ..... 415/55.1, 415/55.2, 55.5, 55.6; 416/228
See application file for complete search history.

(56) References Cited

U.S. PATENT DOCUMENTS

| | | | | |
|---|---|---|---|---|
| 3,315,607 | A | 4/1967 | MacInnes | |
| 5,338,165 | A * | 8/1994 | Brockner et al. | 417/423.1 |
| 6,402,460 | B1 * | 6/2002 | Fischer et al. | 415/55.1 |

FOREIGN PATENT DOCUMENTS

| | | |
|---|---|---|
| DE | 872 819 | 4/1953 |
| DE | 38 23 514 A1 | 1/1990 |
| DE | 41 34 875 A1 | 4/1993 |
| DE | 43 33 204 C2 | 6/1994 |
| DE | 196 07 573 A1 | 10/1996 |
| DE | 197 49 406 A1 | 5/1999 |
| GB | 2 036 179 A | 6/1980 |

* cited by examiner

*Primary Examiner*—Ninh H. Nguyen
(74) *Attorney, Agent, or Firm*—Richard A. Speer; Mayer, Brown, Rowe & Maw LLP

(57) ABSTRACT

In a feed pump (2), guide vanes (9) fastened on a driven impeller (7) project into a recess (11) of a molding (8) annularly surrounding the impeller (7). The guide vanes (9) are located with a slight clearance opposite the wall of the recess (11). The guide vanes (9) can thereby have a particularly large surface. Moreover, a depositing of dirt in the radially outer region of the impeller (7) is avoided.

3 Claims, 2 Drawing Sheets

DELIVERY PUMP

BACKGROUND OF THE INVENTION

The invention relates to a feed pump, in particular a fuel pump, with a driven impeller rotating between two casing parts and carrying guide vanes delimiting at least one ring of vane chambers, with a part-annular channel arranged in the region of the vane chambers in the casing parts and extending from an inlet duct to an outlet duct, and with a fixed molding arranged on the outer circumference of the impeller, the molding having a recess adjacent to the part-annular channel.

Such a feed pump, designed as a peripheral pump, is known, for example, from DE 43 33 204 C2. In this feed pump, guide vanes arranged on both sides of the impeller are arranged on the outer circumference. The molding has a radially inward-pointing edge axially delimiting two recesses. This edge is located opposite the outer boundaries of guide vanes. DE 196 07 573 A1 discloses a feed pump, in which one edge of the impeller and one edge of the molding are located opposite one another.

These feed pumps have the disadvantage that the guide vanes have only a very small configuration in relation to the total cross-sectional area of the part-annular channel, of the recess and of the vane chambers. As a result, only a very low momentum can be transmitted to the flow to be conveyed. The feed pumps consequently have particularly low efficiency.

The problem on which the invention is based is to configure a feed pump of the type initially mentioned, in such a way that it has particularly high efficiency.

BRIEF DESCRIPTION OF THE INVENTION

This problem is solved, according to the invention, in that the guide vanes project into the recess of the molding and are located with a slight clearance opposite the wall of the recess.

By virtue of this configuration, the vane chambers are arranged partially in the region of the molding. As a result, the guide vanes can extend over all the regions located outside the part-annular channel. The guide vanes therefore have a particularly large area and, moreover, are arranged particularly far on the outside in the radial direction. The feed pump according to the invention consequently has particularly high efficiency. As compared with a side channel pump, in which the vane chambers are arranged completely in one end face of the impeller, the feed pump according to the invention has the advantage of being particularly insensitive to contamination of the medium to be conveyed, since, in the radially outer region of the impeller, there are no plane surfaces of the impeller and of the pump casing which are located opposite one another and between which dirt may accumulate. This leads, particularly in the case of the feed pump used as a fuel pump, to particularly low susceptibility to wear. The molding may be designed as a spacer spacing the casing parts from one another.

In the case of two rings of guide vanes arranged in each case in one end face of the impeller, the feed pump according to the invention has particularly high efficiency when the molding has two recesses delimited by a radially inward-pointing edge and when guide vanes arranged on end faces located opposite one another are located with a slight clearance opposite the axial boundaries of the edge.

According to another advantageous development of the invention, turbulences of the medium to be conveyed, in the region of the recess, can be kept particularly low when the guide vanes have an arcuate configuration in their region projecting into the recess. Preferably, the guide vanes have essentially a semicircular shape in a radial section through the impeller.

According to another advantageous development of the invention, dirt adhering to surfaces of the molding or of the casing parts can be avoided particularly reliably when the guide vanes project beyond an outer edge of the impeller by at least half their height.

The feed pump according to the invention can be configured selectively for a separation or an axial throughflow of vane chambers located opposite one another when the outer edge of the impeller and the radially inward-pointing edge of the molding are located with an intended clearance opposite one another.

The assembly of the feed pump according to the invention becomes particularly simple when the molding has at least two ring elements.

According to another advantageous development of the invention, the molding can have a closed ring shape and therefore be produced and assembled particularly cost-effectively when the impeller has a two-layer configuration.

Wear leading to a lowering of the efficiency of the feed pump according to the invention can be avoided in a simple way when the molding is manufactured from a harder material than the impeller.

The feed pump according to the invention has particularly high stability when, in the case of an impeller manufactured from plastic, the molding has in the region of the recess a wall made from metal or ceramic.

BRIEF DESCRIPTION OF THE DRAWINGS

The invention permits numerous embodiments. In order to make its basic principle even clearer, two of these are illustrated in the drawing and are described below. In the drawing

DETAILED DESCRIPTION OF THE INVENTION

Figure 1:
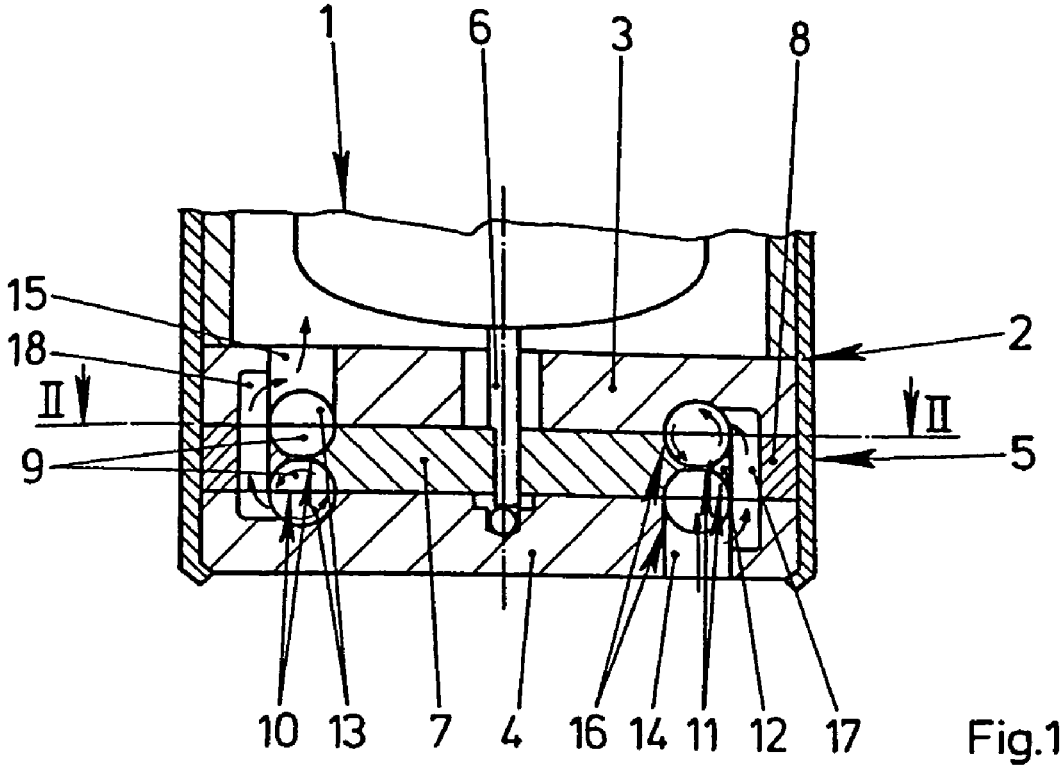
FIG. 1 shows a sectional illustration through a feed pump according to the invention.

FIG. 1 shows a feed pump 2 driven by an electric motor 1, for example for the conveyance of fuel in a present-day motor vehicle. The feed pump 2 has an impeller 7 driven between two casing parts 3, 4 of a pump casing 5 and fastened on a shaft 6 of the electric motor 1. The casing parts 3, 4 are held with a clearance by means of an annular molding 8. The impeller 7 has, on each of its end faces, a ring of vane chambers 10 delimited by guide vanes 9. The guide vanes 9 in this case project beyond the edge of the impeller 7 and penetrate into peripheral recesses 111 of the molding 8. Between the recesses 11, the molding 8 has an edge 12 projecting radially inward between guide vanes 9 opposite one another. Part-annular channels 13 are arranged in those regions of the casing parts 3, 4 which are located opposite the vane chambers 10. The vane chambers 10 and the part-annular channels 13 form feed chambers 16 extending from an inlet duct 14 to an outlet duct 15 of the feed pump 2. The inlet duct 14 and the outlet duct 15 in each case have an overflow duct 17, 18 arranged in the molding 8 and led past the impeller 7. When the impeller 7 is driven by the electric motor 1, the medium to be conveyed is sucked through the inlet duct 14 and is led to the outlet duct 15 via the feed chambers 16. Circulation flows are formed in each case within the feed chambers 16. For the sake of clarity, the flows of the conveyed medium are marked by arrows in the drawing.

Figure 2:
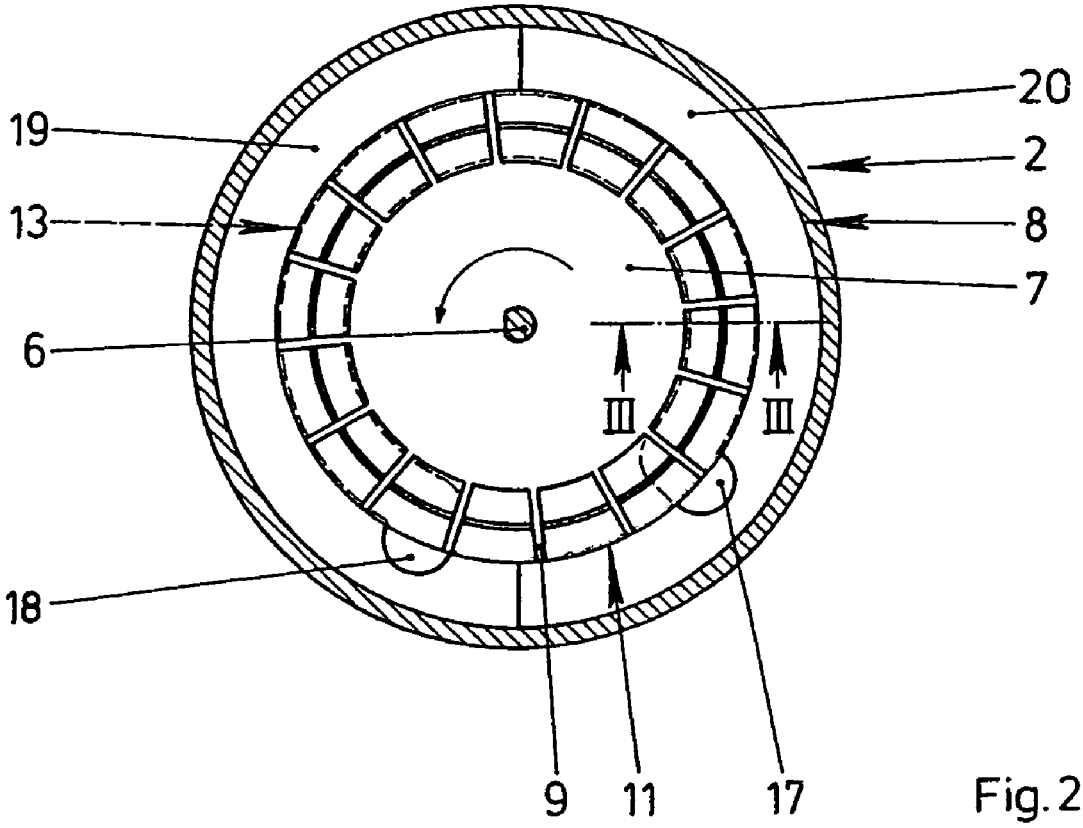
FIG. 2 shows a sectional illustration through the feed pump from FIG. 1 along the line II—II.

The inlet duct 14 and the outlet duct 15 are illustrated in FIG. 1 as being rotated into the sectional plane. As FIG. 2 shows in a sectional illustration through the feed pump 2 from FIG. 1 along the line II—II, the part-annular channels 13 extend over an angular range of approximately 300°. The guide vanes 9 extend, in each case over half their height, in the impeller 7 and in the recess 11 of the molding 8. The molding 8 is composed of two ring elements 19, 20.

Figure 3:
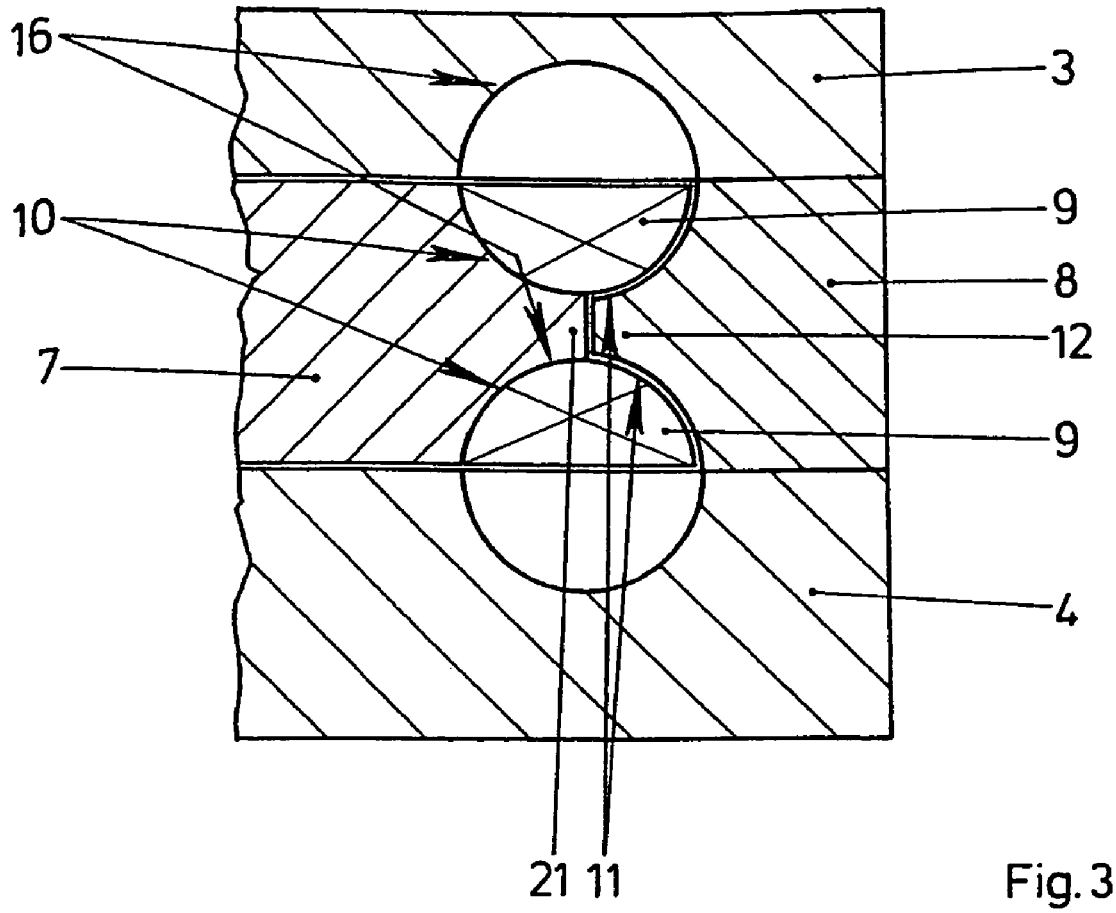
FIG. 3 shows a greatly enlarged sectional illustration through the feed pump from FIG. 2 along the line III—III.

FIG. 3 shows, greatly enlarged, a part region of the feed pump 2 from FIG. 2 in a sectional illustration along the line III—III. It can be seen, here, that the guide vanes 9 have an approximately semicircular configuration. The recesses 11 of the molding 8 have an arcuate contour corresponding to the region of the guide vanes 9 which projects beyond the impeller 7. In this case, those regions of the guide vanes 9 which project into the recesses 11 of the molding 8 are located with a slight clearance opposite the wall of said molding. As a result, a part region of the vane chambers 10 is arranged within the molding 8. The radially inward-pointing edge 12 of the molding 8 is located with slight clearance opposite a radially outward-pointing edge 21 of the impeller 7.

Figure 4:
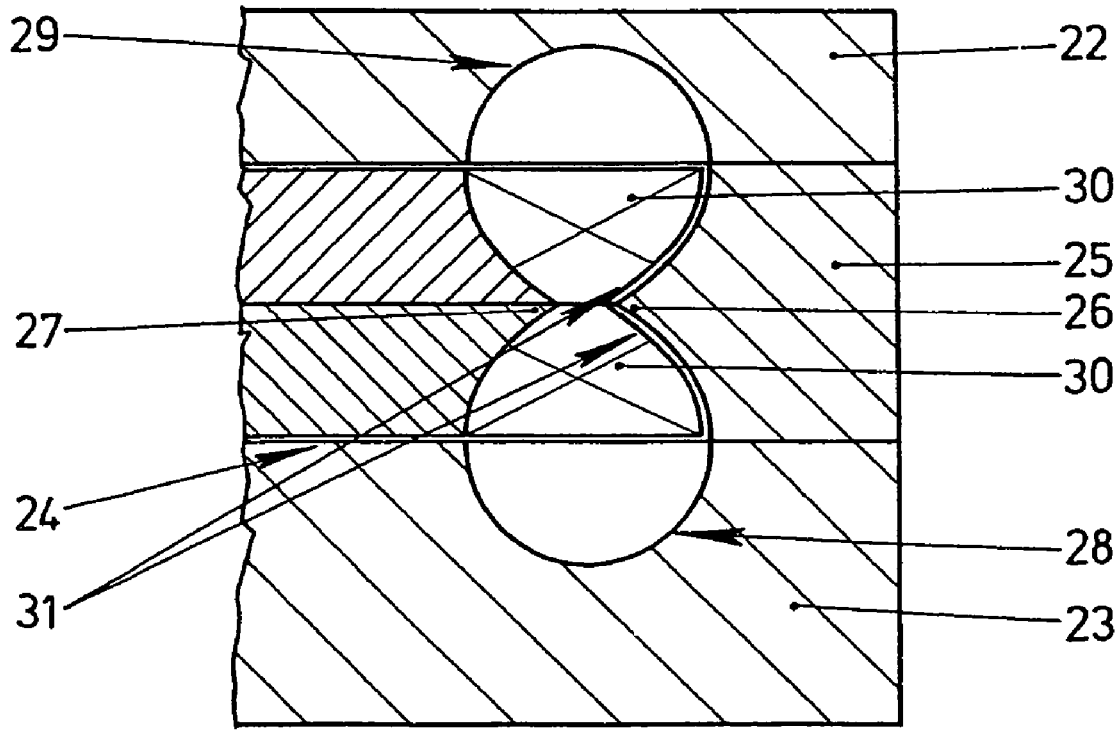
FIG. 4 shows a greatly enlarged sectional illustration of a further embodiment of the feed pump in the region of a feed chamber.

FIG. 4 shows a part section through a radially outer region of a further embodiment of the feed pump 2 from FIG. 1. This embodiment differs from that of FIG. 3, above all, in that an impeller 24 rotating between two casing parts 22, 23 has a two-layer configuration. As a result, a molding 25 holding the casing parts with a clearance can be configured annularly in one piece. A radially inward-pointing edge 26 of the molding 25 has a clearance in relation to a radially outward-pointing edge 27 of the impeller 24. The medium to be conveyed can thereby flow from one feed chamber 28 over into the other feed chamber 29. Overflow ducts 17, 18 illustrated in FIG. 1 are therefore unnecessary. As in the embodiment illustrated in FIG. 3, guide vanes 30 fastened on the impeller 24 project into recesses 31 of the molding 25 and are located with a slight clearance opposite the wall of the latter.

The invention claimed is:

1. A feed pump in particular a fuel pump, with a driven impeller (7, 24) rotating between two casing parts and carrying guide vanes delimiting at least one ring of vane chambers, with a part-annular channel arranged in the region of the vane chambers in the casing parts and extending from an inlet duct to an outlet duct, and with a fixed molding manufactured from a harder material than the impeller (7, 24) arranged on the outer circumference of the impeller, the molding having a recess adjacent to the part-annular channel, characterized in that the guide vanes (9, 30) project into the recess (11, 31) of the molding (8, 25) and are located with a slight clearance opposite the wall of the recess (11, 31).

2. A feed pump having a driven impeller manufactured from plastic, rotating between two casing parts and carrying guide vanes delimiting at least one ring of vane chambers, with a part annular channel arranged in the region of the vane chambers in the casing parts and extending from an inlet duct to an outlet duct and with a fixed molding arranged on the outer circumference of the impeller, the molding having a recess and in the region of the recess a wall made from metal or ceramic.

3. The feed pump as claimed in claim 1 or 2, characterized in that the molding (8, 25) has two recesses (11, 31) delimited by a radially inward-pointing edge (12, 26) and in that guide vanes (9, 30) arranged on end faces located opposite one another are located with a slight clearance opposite the axial boundaries of the edge (12, 26).

* * * * *